United States Patent [19]

Lundstrom et al.

[11] Patent Number: 5,070,781

[45] Date of Patent: Dec. 10, 1991

[54] CARD EMBOSSING APPARATUS AND METHOD

[75] Inventors: Robert W. Lundstrom, Plymouth; Benjamin H. Sannel, St. Louis Park; Dennis J. Warwick, Richfield, all of Minn.

[73] Assignee: DataCard Corporation, Minnetonka, Minn.

[21] Appl. No.: 696,320

[22] Filed: Apr. 30, 1991

Related U.S. Application Data

[63] Continuation of Ser. No. 464,569, Jan. 16, 1990, abandoned, which is a continuation of Ser. No. 276,234, Nov. 23, 1988, abandoned.

[51] Int. Cl.[5] ..... B41J 1/06

[52] U.S. Cl. ..... 101/32; 101/18; 400/130; 400/131; 400/134

[58] Field of Search ..... 101/18, 19, 29, 31, 101/32; 400/130-131, 134-134.2, 129, 157.3

[56] References Cited

U.S. PATENT DOCUMENTS

| | | | |
|---|---|---|---|
| 402,999 | 5/1889 | Stranahan . | |
| 1,203,113 | 10/1916 | Henry . | |
| 1,779,091 | 10/1930 | Glass . | |
| 2,055,051 | 9/1936 | Sandt . | |
| 2,115,456 | 4/1938 | Chisholm | 400/131 |
| 2,927,676 | 3/1960 | Abbondanza | 400/130 |
| 3,124,064 | 3/1964 | Schick . | |
| 3,253,691 | 5/1966 | Gollwitzer . | |
| 3,263,789 | 8/1966 | Schacht | 400/131 |
| 3,282,389 | 11/1966 | Rudisch et al. . | |
| 3,283,870 | 11/1966 | Gollwitzer . | |
| 3,430,557 | 3/1969 | Peters . | |
| 3,638,563 | 2/1972 | Drillick . | |
| 3,669,014 | 6/1972 | Spaw et al. . | |
| 3,757,684 | 9/1973 | Drillick . | |
| 3,820,455 | 6/1974 | Hencley et al. | 101/3.1 |
| 3,842,956 | 10/1974 | Reilly et al. . | |
| 3,861,299 | 1/1975 | Drillick | 400/130 |
| 3,865,224 | 2/1975 | Faust et al. | 101/29 |
| 3,921,781 | 11/1975 | Corte | 101/18 |
| 4,031,993 | 6/1977 | Gürgens et al. . | |
| 4,050,565 | 9/1977 | Heider et al. . | |
| 4,088,216 | 5/1978 | Lamanna et al. | 400/130 |
| 4,091,910 | 5/1978 | Bolton et al. | 101/32 |
| 4,091,910 | 5/1978 | Bolton et al. . | |
| 4,180,338 | 12/1979 | La Manna et al. . | |
| 4,255,073 | 3/1981 | Schöttle . | |
| 4,271,012 | 6/1981 | LaManna et al. . | |
| 4,276,824 | 7/1981 | Schöttle . | |
| 4,378,733 | 4/1983 | Polad et al. . | |
| 4,384,711 | 5/1983 | Gabel et al. . | |
| 4,386,860 | 6/1983 | Price et al. . | |
| 4,476,507 | 10/1984 | Koike et al. . | |
| 4,519,600 | 5/1985 | Warwick et al. . | |
| 4,548,519 | 10/1985 | Schroeder . | |
| 4,616,128 | 10/1986 | Case . | |
| 4,686,898 | 8/1987 | LaManna et al. . | |
| 4,688,785 | 8/1987 | Nubson et al. . | |
| 4,747,706 | 5/1988 | Duea . | |
| 4,755,069 | 7/1988 | Lamanna et al. | 400/130 |
| 4,784,059 | 11/1988 | LaManna et al. | 101/18 |
| 4,900,168 | 2/1990 | LaManna et al. | 400/130 |

FOREIGN PATENT DOCUMENTS

| | | | |
|---|---|---|---|
| 630896 | 11/1961 | Canada | 101/3.1 |
| 1228790 | 9/1960 | France | 101/29 |
| 8703539 | 6/1987 | PCT Int'l Appl. | 400/134 |

*Primary Examiner*—Eugene H. Eickholt

*Attorney, Agent, or Firm*—Merchant, Gould, Smith, Edell, Welter & Schmidt

[57] ABSTRACT

An embossing apparatus (22) includes an embossing wheel (28) having a punch side (30) and a die side (32). The embossing wheel (28) has punch blocks (50) and die blocks (52) spaced around its periphery. A card (20) is carried to an embossing position by card transport (24) and aligned by a guide plate (36). The embossing is done by pushing the punch blocks (50) and die blocks (52) against the card (20) by a hammer (**42, 42*a*) driven by a solenoid (38, 38*a*). Character return plates (46, 46*a*), located on the outer sides of the embossing wheel (28) engaging the inside of character blocks (35), spring the character blocks (35) and solenoid shaft (40, 40*a*) back to a home at rest position when the embossing stroke is completed. The solenoids (38, 38*a*) have bumpers (54, 54*a*) mounted thereon for controlling the motion of the shaft (40, 40*a***).

17 Claims, 7 Drawing Sheets

CARD EMBOSSING APPARATUS AND METHOD

This is a continuation of now abandoned application Ser. No. 07/464,569, filed Jan. 16, 1990, which is a continuation of now abandoned Ser. No. 07/276,234, filed on Nov. 23, 1988 now abandoned.

BACKGROUND OF THE INVENTION

The present invention relates to an embossing system and, more particularly, to a system for embossing characters on a medium such as a plastic credit card, identification card, or membership card and performing such embossing functions under automated control.

Automated embossing systems are widely known in the field. Prior systems are disclosed in U.S. Pat. No. 4,378,733 to Polad et al. and U.S. Pat. No. 4,088,216 to LaManna et al. and in U.S. patent application Ser. No. 204,499 to Warwick et al. filed June 9, 1988. Each of these systems are used for embossing operations having similar speeds and throughput rates.

The Polad and LaManna systems employ a complicated mechanism to achieve the embossing. Embossing wheels mount embossing punch blocks and die blocks which are struck by large bail arms requiring a complex linkage having a number of moving parts. The large bail arms require ample space for proper operations. The associated linkage is relatively expensive and must be properly adjusted for maintaining the consistent embossing height required in embossing operations. With a complicated linkage such as the prior art, skilled technicians are required for these adjustments, increasing maintenance costs. The large number of moving parts also increases the occurrences of malfunctions or misalignments, thereby reducing reliability and performance.

The LaManna patent implements individual return springs for each character block for returning the character block to a home position after the embossing stroke. The individual return springs for each character block require extensive assembly time and greatly increase manufacturing costs.

The Warwick et al. application discloses an embossing drive apparatus wherein solenoids drive the hammers without the use of bail arms. The application discloses return springs on each character block and a return plate (90) shown in FIG. 1 for returning character blocks to a home position. The return plate mounts on the solenoid and pulls the character block back when the plunger returns to its at rest deenergized position. A spring (62) forces the plunger back to the at rest position.

Another known return device is a flexible disk engaging the inside edge of the ring of character blocks. The flexible disk is unsatisfactory as it develops unwanted stresses, is prone to wear and does not set the character blocks in a straight position for embossing.

Other problems encountered with prior systems are inconsistent emboss height and card bowing. The character block ends of the bail arms do not always stop at the same position during each stroke, thereby embossing some characters at different heights. The card is not properly supported in prior systems during embossing, resulting in card bowing. As the punch and die engage the card, the card tends to bow toward the punch side around the character location without card support on the punch side of the card. Bowing is aesthetically unpleasing and leads to problems in encoding and reading magnetic stripes on cards.

It is evident that the prior art does not satisfy the need for a low cost embossing apparatus which obtains consistent emboss height and reduces card bowing. The prior art does not have a satisfactory low cost method for returning character blocks following embossing. The present invention solves these and other problems associated with embossing mechanisms.

SUMMARY OF THE INVENTION

The present invention relates to an embossing apparatus for embossing characters onto a plastic card such as a credit card, identification card, or membership card. An embossing apparatus includes an embossing wheel and a drive mechanism for rotating the wheel. The embossing wheel includes associated punches and dies for embossing characters onto the card.

In a preferred embodiment, the embossing apparatus includes a transport system providing vertical and horizontal movement of the card past other card processing mechanisms such as a topping mechanism. The transport system may include input and output hoppers for completely automatic embossing operations.

The embossing wheel comprises a punch side and a die side, each side having a ring of character blocks spaced around the periphery of the wheel corresponding to the same character block on the opposite side. The card is transported to a position so that an embossing location on the card is between the punch and die sides corresponding to an embossing position which is at the top character position of the embossing wheel. The wheel is then rotated to the embossing position whereat the punch and die blocks of the selected character align with the character embossing location on the card. Drive solenoids on each side of the wheel are actuated, driving a shaft having a hammer attached thereto. A first hammer strikes the character punch, driving the punch against the card, while a second hammer on the opposite side strikes the opposing die for forming a raised character.

A guide plate on both sides of the card aligns the card between the embossing wheel sides. The guide plate is adjusted so that one side acts as a card bow control guide plate. The card bow control guide plate supports the card so that card bowing during and after embossing is minimized. The hammer positions are adjusted relative to the card bow control guide plate to set emboss height and to minimize card bowing.

The solenoids fire from two pulses, a first short pulse having a low current drives a shaft so that the hammer pushes the character block against the card. The second pulse has a higher current held for a longer duration for driving the character block into the card, forming a raised letter. The solenoid shaft attaches to a plate at the rear of the shaft. Upon actuation of the shaft, the plate strikes bumpers on the rear of the solenoid body. The bumpers have a high damping ratio for absorbing the shock of the plate during actuation of the solenoid and for reducing noise. The shaft's motion is stopped at the same point of each stroke as the plate strikes the rear of the solenoid body so that consistent emboss height is attained.

Character return plates located on each of the outer sides of the embossing wheel within the character block ring then spring the character punch blocks and die blocks back to a home at rest position. The character return plates also engage pushers on the shafts, aiding the shafts in returning to a home position. The character return plates engage a lip of each character block for returning the character blocks to an at rest position. The pusher engages the character return plate during the embossing stroke so that the character return plate does not engage and tilt the character block during embossing. The solenoid is then disengaged and the shaft retracted, so that the hammer disengages the character block and the pusher disengages the character return plate. The character return plate pushes the character block back to a home at rest position. The card is then positioned for embossing a next character location, the wheel is rotated so that the selected character punch and die blocks are at the embossing position and the solenoids are actuated, repeating the character embossing steps until the card is finished. Alternatively, the character return plate includes fingers extending on either side of the character blocks and being pushed ahead of the character block by the hammer. The character block is not tilted by the character return plate and does not require a pusher. The card bow control guide plate aligns the card and supports the card around the character embossing location to minimize card bowing during the embossing steps. When embossing is complete, the card is transported to the next processing station.

These and various other advantages and features of novelty which characterize the invention are pointed out with particularity in the claims annexed hereto and forming a part hereof. However, for a better understanding of the invention, its advantages and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF A PREFERRED EMBODIMENT

Figure 7:
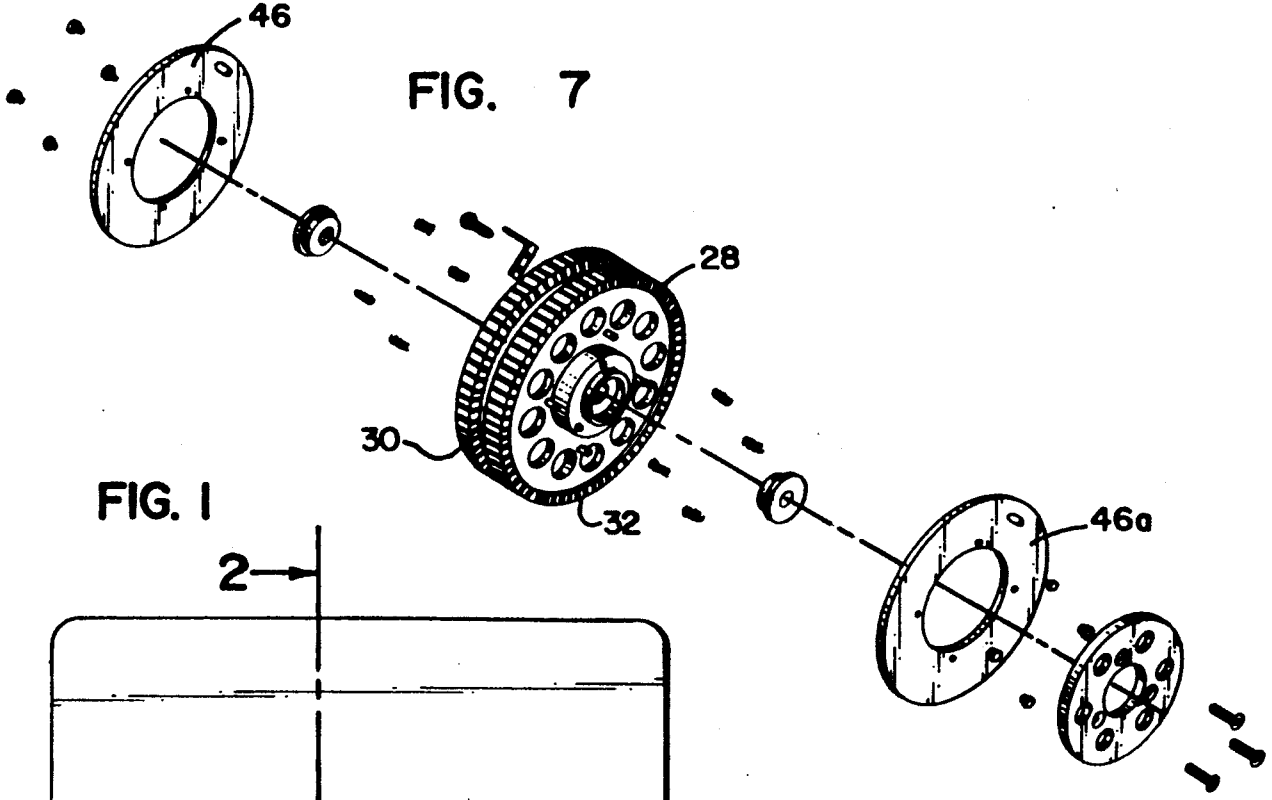
FIG. 7 is an exploded view of character return plates and the embossing wheel.
Figure 1:
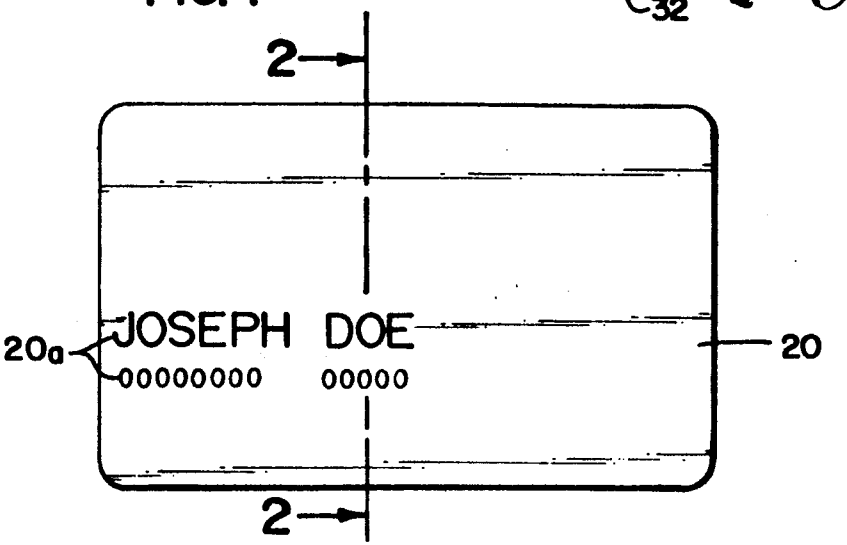
FIG. 1 is a front elevational view of a common credit card having raised lettering.
Figure 2:
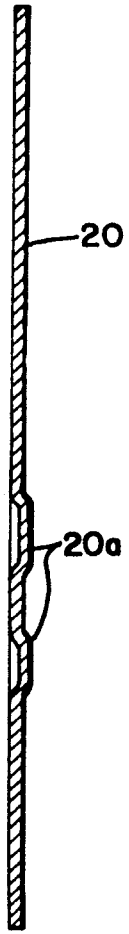
FIG. 2 is a sectional view of the credit card shown in FIG. 1 taken along line 2—2, illustrating raised lettering.
Figure 3:
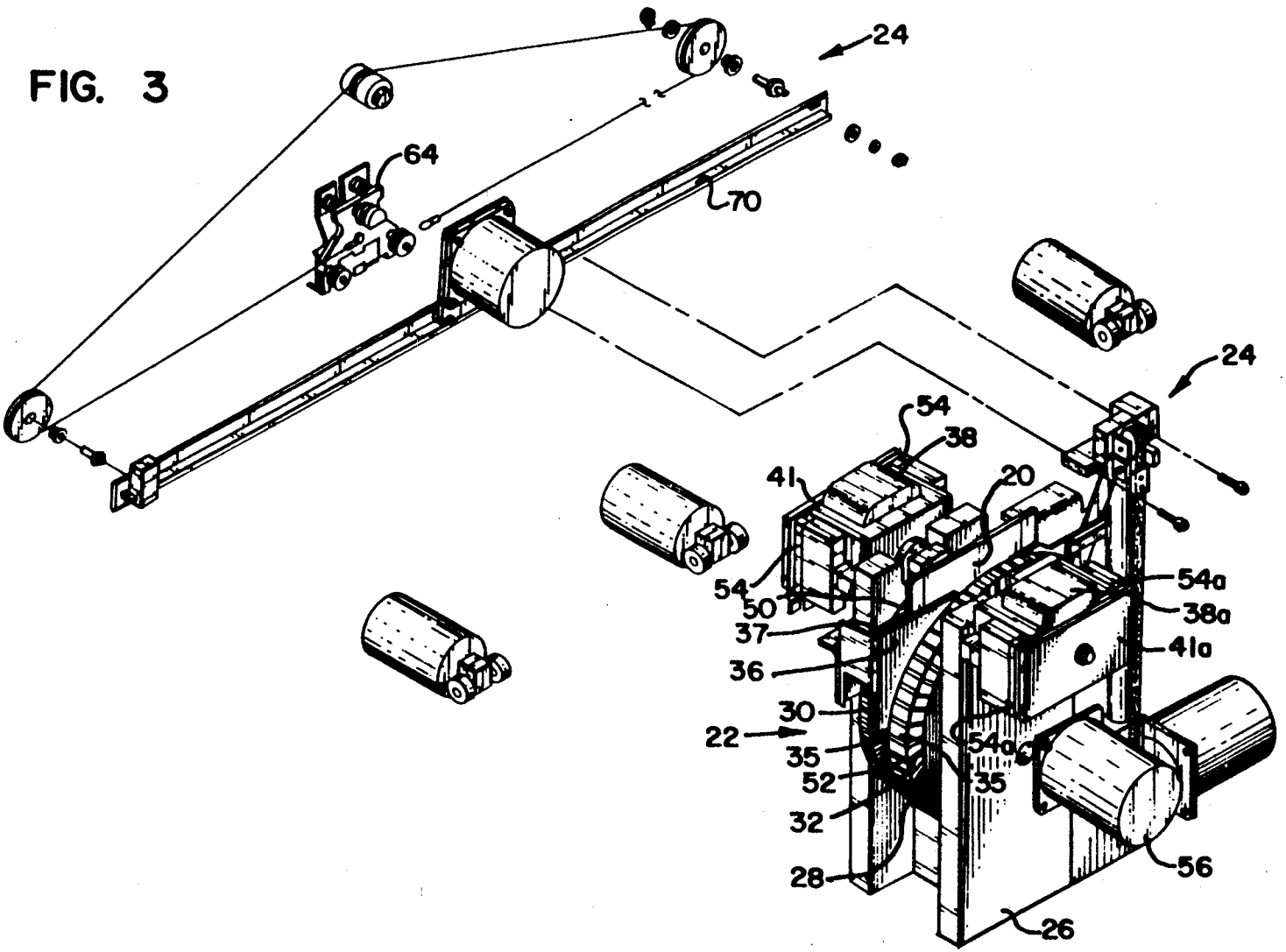
FIG. 3 is a partially exploded perspective view of an embodiment of an embossing apparatus according to the principles of the present invention and a transport system transporting a card through the embossing apparatus.

Plastic cards having raised lettering are well known and used for a variety of purposes, such as credit cards, membership cards, and identification cards. A card 20 shown in FIG. 1 includes raised lettering 20*a* as shown in FIGS. 1 and 2. Illustrated in FIG. 3 is an embodiment of an embossing apparatus in accordance with the principles of the present invention and generally designated 22. Each card 20 is carried to the embossing apparatus 22 and retained by a suitable card transport 24. The card transport 24 might retain the card in a carriage 64 for other card processing operations such as topping the raised lettering 20*a*. It will be appreciated that the card transport 24 may take on several well known suitable designs and still be in keeping with the principles of the invention.

Figure 4:
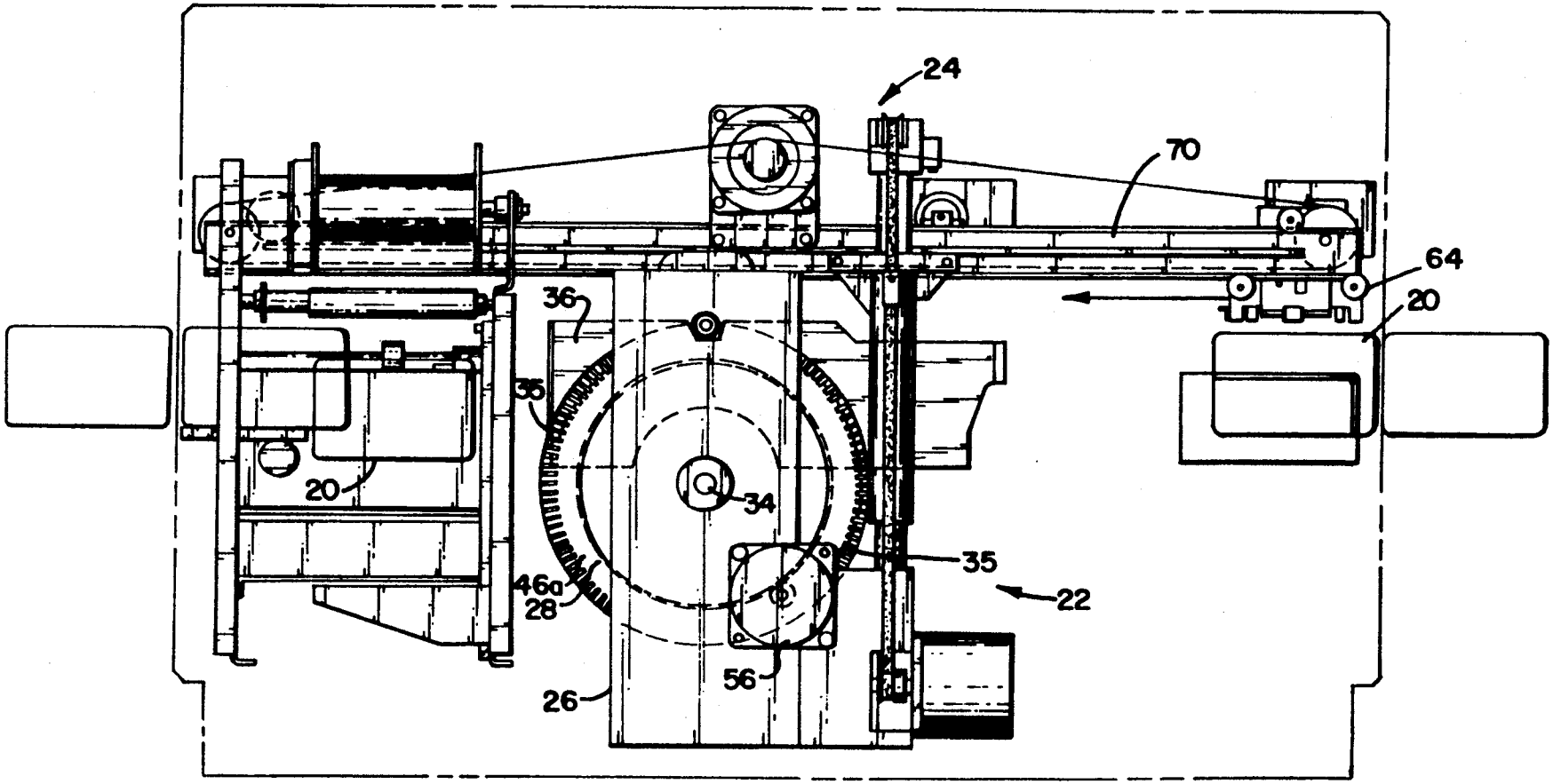
FIG. 4 is a front elevational view of the embossing apparatus shown in FIG. 3.

As shown in FIGS. 3 and 4, the embossing apparatus 22 includes an embossing wheel 28 including character blocks 35 and having a punch side 30 opposing a die side 32 rotating on an axle 34 supported by frame 26. The punch side 30 comprises a multiplicity of character blocks 35 comprising punch blocks 50 spaced about the periphery of the punch side 30 of the embossing wheel 28, each punch block 50 having a different character for embossing. The die side 32 comprises a multiplicity of character blocks 35 comprising die blocks 52 spaced about the periphery of the die side 32 of the embossing wheel 28 corresponding to the associated punch blocks 50 on the punch side 30 of the embossing wheel 28.

Figure 5:
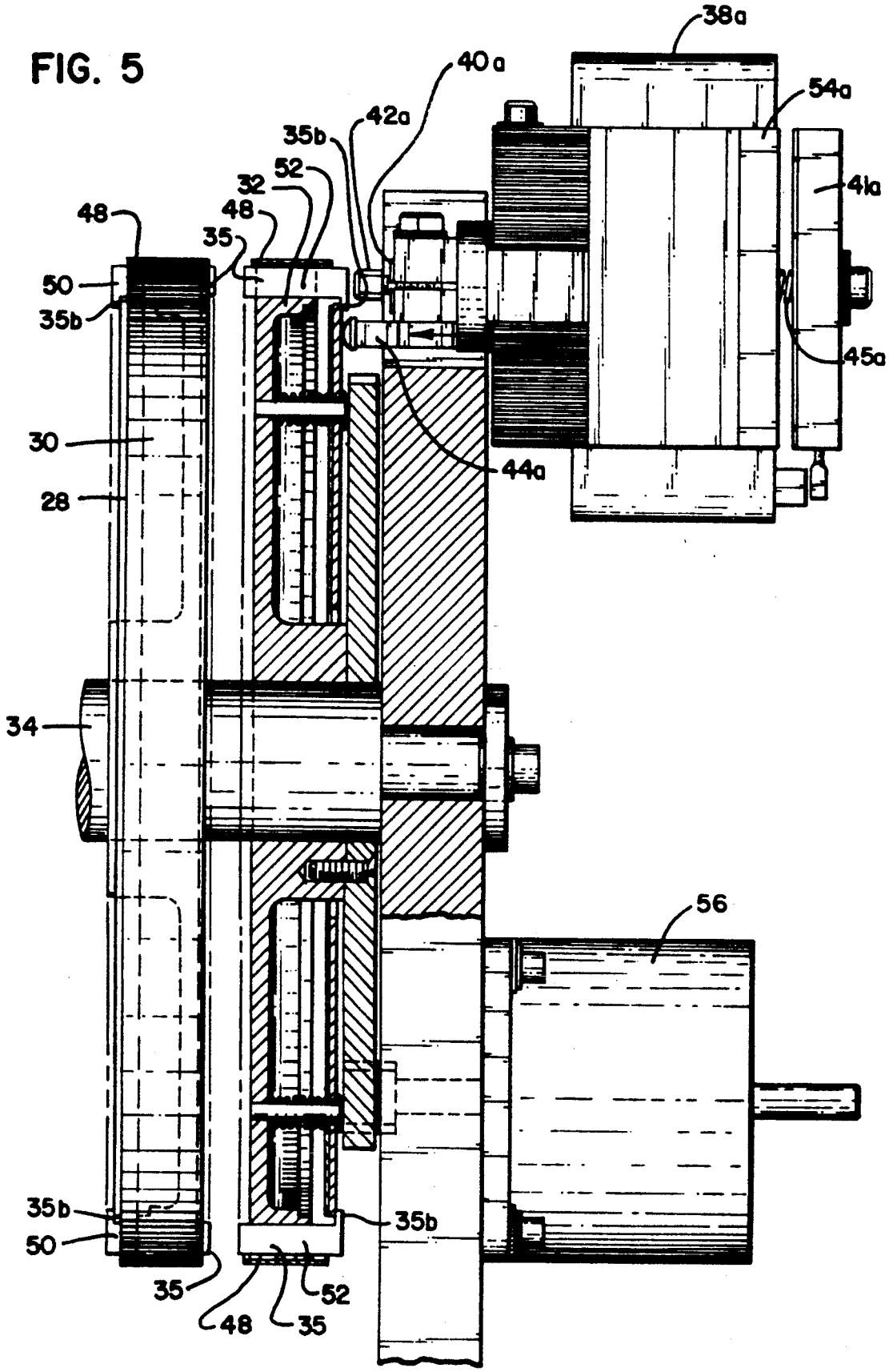
FIG. 5 is a side sectional view of the embossing wheel, the card bow control plate and solenoid shown in FIG. 3.
Figure 6:
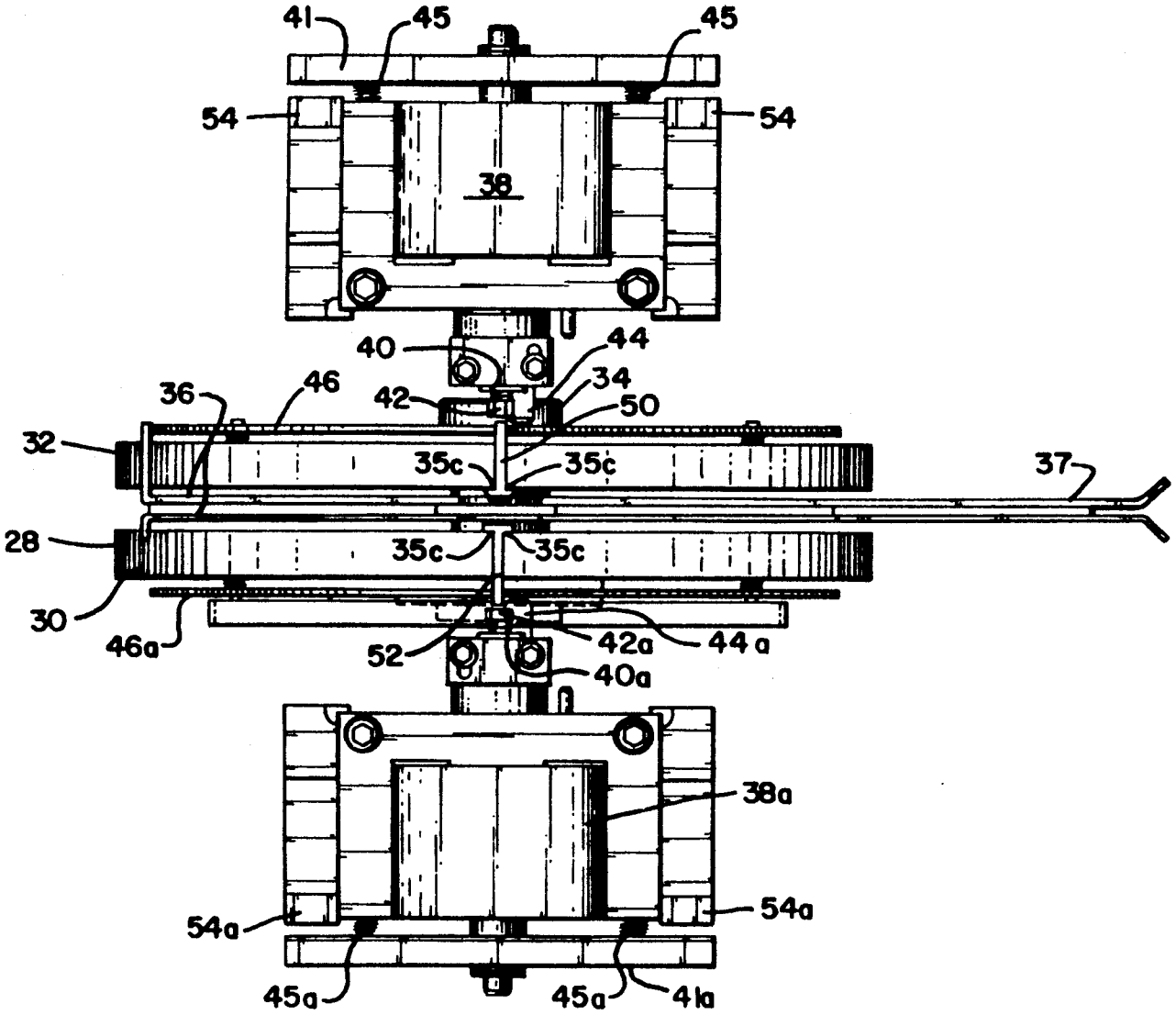
FIG. 6 is a top view of the embossing apparatus shown in FIG. 3 showing the embossing wheel, the guide plate and the solenoids.

Retaining bands 48 keep the character blocks 35 retained against the outer rims of the embossing wheel 28 as shown in FIG. 5. The motion of the character blocks 35 parallel to the axis of rotation of the embossing wheel 28 is limited by a rear lip 35*b*, and as shown in FIG. 6, side members 35*c* of the character blocks 35 engaging the embossing wheel 28.

For embossing, the card 20 is moved to a position between the punch side 30 and die side 32 of the embossing wheel 28. The card 20 is aligned and supported by a guide plate 36 as shown in FIG. 3.

The embossing wheel 28 is rotated so that the selected punch block 50 and die block 52 are at a topmost position of the wheel 28, proximate to the character embossing location on the card 20. The guide plate 36, including a thicker side comprising a card bow control guide plate 37 on the punch side of the card 20, is notched, as shown in FIG. 4, so that the punch block 50 and die block 52 strike the card 20, while supporting the card 20 on either side and below the character embossing location, thereby decreasing card bowing. As shown in FIG. 6, solenoids 38 and 38*a* disposed on either side of the embossing wheel 28 include shafts 40 and 40*a* having hammers 42 and 42*a* threadably adjustably attached thereto and pushers 44 and 44*a* attached to shafts 40 and 40*a* disposed below the hammers 42 and 42*a*. When the solenoids 38 and 38*a* are actuated, the shafts 40 and 40*a* having plates 41 and 41*a* attached at the rear, drive hammers 42 and 42*a* for engaging a punch block 50 and a die block 52. The card 20 is held between the punch block 50 and die block 52 in the card carriage 64 and aligned and supported by the guide plate 36. When the punch block 50 and die block 52 strike the card 20, a raised letter 20*a* is formed.

The solenoids 38 and 38*a* are fired by two electrical pulses. A first pulse having a short duration and low current level drives the shafts 40 and 40*a* so that the hammers 42 and 42*a* engage the character blocks 35 to coast up against the card 20. The second pulse, having a higher current level and longer duration than the first electrical pulse, drives the character blocks 35 against the card surface and holds the shafts 40 and 40*a* so that a raised letter 20*a* is formed. The solenoids 38 and 38*a* include bumpers 54 and 54*a*, having a high damping ratio, at the rear of the solenoids 38 and 38*a*. The plates 41 and 41*a* engage the rear of solenoids 38 and 38*a* for stopping the motion of the shafts 40 and 40*a* at the same point of each stroke so that consistent embossing height on the characters 20*a* is attained. The bumpers 54 and 54*a* absorb the shock of the shafts 40 and 40*a*, by engaging plates 41 and 41*a* prior to striking the rear of solenoids 38 and 38*a*. This reduces wear on the parts and reduces noise.

Figure 8:
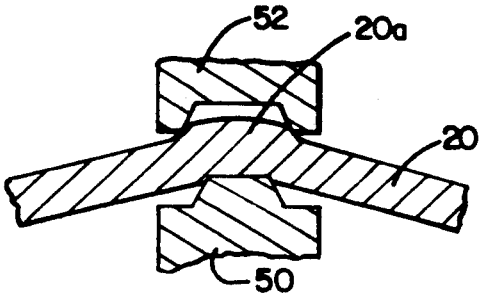
FIG. 8 PRIOR ART
FIG. 8 is a detail of a prior art punch block and die block embossing a card, illustrating card bowing without a card bow control guide plate.
Figure 9:
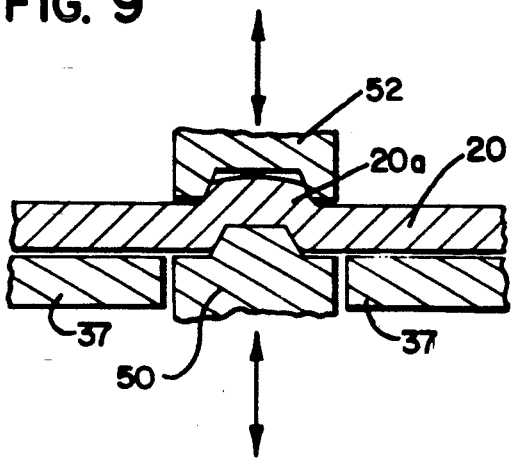
FIG. 9 is a detail of a punch block and die block embossing a card, including a card bow control guide plate limiting card bowing according to the present invention.

As shown in FIG. 8, card bowing will occur during embossing without a bow control guide plate. The card 20 bows toward the punch block 50 around the raised character 20*a*. The bowing remains after the character is embossed. In FIG. 9, a preferred embodiment is shown including the card bow control guide plate 37. As the card 20 is embossed, the card 20 tends to bow around the punch block 50, as in FIG. 8, but is prevented from bowing by the card bow control guide plate 37. It can be appreciated that for minimal bowing, the card bow control guide plate 37 must be properly positioned relative to the punch bloc 50. If the card bow control guide plate 37 projects too far into the card path, the card 20 may bow toward the die block 52. If the card bow control guide plate 37 is too far from the card 20, deflection is not limited, and card bowing is not controlled.

For adjusting the card bow control guide plate 37, the guide plate 36 is aligned so that the card 20 is retained in the card path. The hammer 42 is threadably adjusted on the shaft 40 so that the embossing stroke ends with the punch block 50 at a position relative to the card bow control guide plate 37 for minimizing bowing. Hammer 42*a* is then adjusted relative to punch block 50 so that the die block 52 finishes its embossing stroke so that the card 20 has correct emboss height. If a different thickness card 20 is used, only the die side hammer 42*a* need be adjusted as the punch block 50 and the card bow control guide plate 37 are still aligned for minimized bowing.

Figure 10:
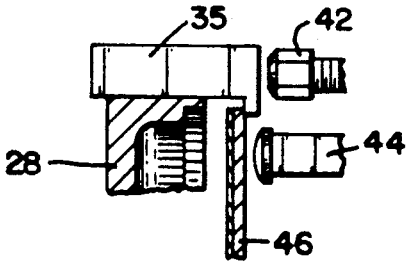
FIG. 10 is a partial sectional view of a detail of the embossing wheel, character block, character return plate, pusher and hammer shown in FIG. 5 in a home position.

As illustrated in FIGS. 10–13, spring loaded return plates 46 push the character blocks 35 and associated hammer 42 back as well as urging the pusher 44 attached to shaft 40, respectively, aiding springs 45 and 45*a* shown in FIG. 6 in returning the shafts 40 and 40*a*. The function of the character return plate 46 mirroring the function of plate 46*a* is more clearly shown in FIGS. 10–13. In FIG. 10, the solenoids are not actuated so that hammer 42 does not engage the character block 35 and the pusher 44 does not engage the character return plate 46.

Figure 11:
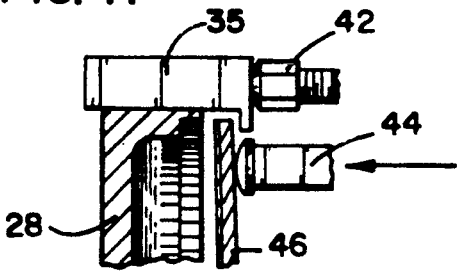
FIG. 11 is a detail of the present invention shown in FIG. 10, illustrating the solenoid shaft partially moved through the embossing stroke.
Figure 12:
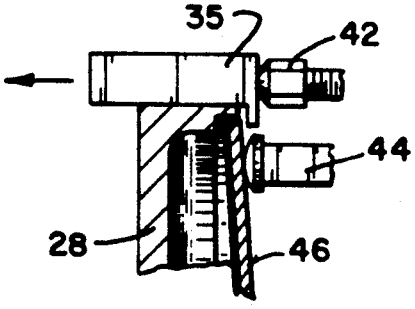
FIG. 12 is a detail of the present invention shown in FIG. 10, illustrating the solenoid shaft fully advanced in the embossing stroke.

In FIG. 11, the hammer 42 and pusher 44 are shown during the beginning of the embossing stroke. The pusher 44 has pushed the character return plate 46 away from the character block 35. The hammer 42 is just engaging the rear of the character block 35. In FIG. 12, the embossing position is shown wherein the hammer 42 and pusher 44 are fully extended. The character return plate 46 does not engage the character block 35 during contact with a card so that the character block 35 will rest flat against the card surface. If there was no pusher 44, the character return plate 46 would push against the character block 35. This would cause the character block 35 to tilt slightly so that the character block 35 would not rest flat against a card. This causes uneven embossing and leads to wear on the character blocks 35, the retaining band 48 and embossing wheel 28.

Figure 13:
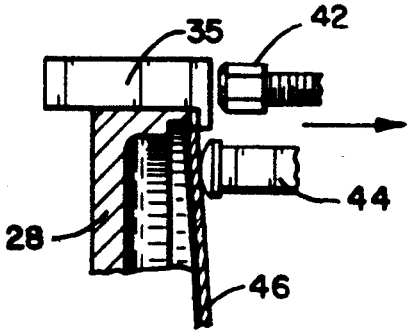
FIG. 13 is a detail of the present invention shown in FIG. 10, illustrating the solenoid shaft partially retracted following embossing and the character return plate engaging the character block.

The return stroke is illustrated in FIG. 13. The hammer 42 and pusher 44 are retracted along with the shaft 40 which is urged by springs 45 shown in FIG. 6. The character return plate 46 engages the character block 35 returning the character block 35 to a home position and aids in urging pusher 44 back to a home position. The hammer 42 and pusher 44 are then fully retracted and the character return plate 46 holds the character block 35 in a home position as shown in FIG. 10. In this manner the character blocks 35 are moved back in a home position and the shaft 40 is also returned to a home position and ready for embossing the next character.

The embossing wheel 28 is then rotated by a motor 56 shown in FIGS. 3, 4, and 5 so that the next character punch block 50 and die block 52 are in the embossing position for embossing the next character. For efficient embossing requiring the least time, a computer program may be implemented such as that disclosed in U.S. Pat. No. 4,747,706 to Duea, assigned to DataCard Corporation, incorporated herein by reference. The program rotates the embossing wheel 28 and moves the carriage 64 so that the characters on each line are embossed in the quickest manner. Characters are not necessarily embossed in the order appearing on the card 20, so that the card transport 24 may be advanced and reversed several times during the embossing of a line of characters. The card transport 24 then raises the card 20 for the remaining lines until the embossing on the card 20 is complete.

Figure 15:
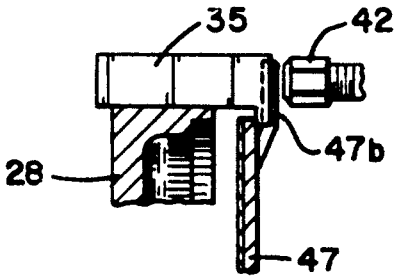
FIG. 15 is a side view of the character block, embossing wheel, hammer and the character return plate as shown in FIG. 14.
Figure 14:
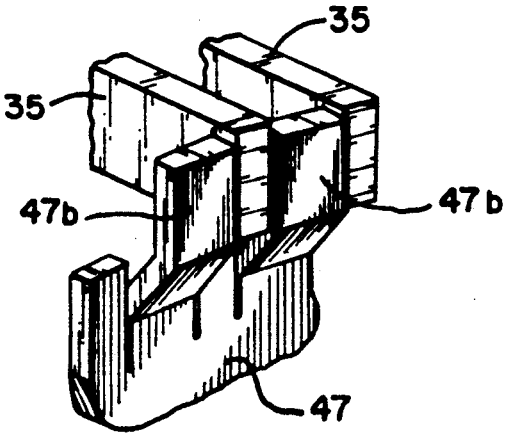
FIG. 14 is a perspective view of a detail of character blocks, and an alternate embodiment of the character return plate in accordance with the principles of the present invention.

A second embodiment of a character return plate is shown in FIGS. 14 and 15. A character return plate 47 includes fingers 47*b* which extend radially from the character return plate 47 between the character blocks 35. As shown in FIG. 15, the character return plate 47 is pushed toward the embossing position by the hammer 42 as the hammer 42 engages the fingers 47*b*. During embossing, the character return plate 47 is pushed in by the hammer 42 so that the character return plate 47 does not engage the character block 35. When the hammer 42 is retracted, the character return plate 47 engages the character block 35, returning to a home position. It will be appreciated that the character return plate 47 does not tilt the character blocks 35 during embossing and does not require a pusher.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An embossing apparatus for embossing a card or sheet material, comprising:

(a) a supporting frame;

(b) an embossing wheel rotatably supported by the supporting frame for rotation about an axis of rotation, the embossing wheel having spaced apart punch and die sides, an embossing location being defined intermediate the punch and die sides;

(c) opposing punch and die character blocks spaced in a ring around the periphery of each side of the embossing wheel, the character blocks being retained around the periphery by retaining bands, the character blocks being slidably retained for movement in a direction parallel to the axis of rotation, the character blocks having a face portion pointing toward the embossing location and a lip portion pointing toward the wheel's axis of rotation, the character blocks being slidable between a card engaging position and a home position;

(d) guide means for aligning and supporting a card between the punch and die sides of the embossing wheel;

(e) transport means for moving the card so that a desired character embossing location on the card is positioned at the embossing location;

(f) wheel rotation means for rotating the embossing wheel so that desired character blocks are aligned with the character embossing location on the card;

(g) hammer means for moving the desired character blocks on each of the punch side and die side of the wheel into the card engaging position so as to emboss a character at the character embossing location on the card;

(h) hammer drive means mounted on the frame for driving the hammer means against the character blocks aligned with the character embossing location on the card;

(i) resilient character return means located intermediate each side of the wheel and the lip portion of the character blocks and engageable with the lip portion of the character blocks for pushing the character blocks back to the home position following the embossing stroke; and (j) pushers mounted on the hammer drive means engaging the character return means so that the character return means does not engage the character blocks at the point of embossing.

2. An apparatus according to claim 1, wherein the hammer drive means comprise a solenoid at either side of the embossing wheel, each solenoid having a shaft driving the hammer means upon actuation of the solenoid.

3. An apparatus according to claim 2, wherein the repeatable hammer stop means comprises the body of the solenoid.

4. An apparatus according to claim 1, wherein the guide means includes a card bow control guide plate on the punch side of the card, the card bow control guide plate positioned so that card bowing during embossing is minimized.

5. An apparatus according to claim 4, wherein the hammer means are adjustable relative to the card bow control guide plate for minimizing card bowing.

6. An apparatus according to claim 1, wherein the character return means comprises a spring loaded disk engaging a lip portion of the character blocks.

7. An apparatus according to claim 1, wherein the duration and power of the hammer drive means shaft strokes are varied for maintaining consistent emboss height.

8. An apparatus according to claim 1 wherein movement of the transport means and rotation of the embossing wheel for embossing the next character is determined from a computer program.

9. An apparatus according to claim 1, wherein the guide plate comprises a substantially planar plate located on either side of the card embossing position and having a notch allowing the associated punch and die blocks to strike an embossing location on the card while supporting the card around the sides and bottom of the character embossing location.

10. An apparatus according to claim 1, wherein the hammer drive means include bumpers for absorbing shock of the plate striking the hammer stop means during embossing.

11. A card embossing apparatus comprising:

(a) a rotatable card embossing wheel including spaced apart punch and die sides rotating about a common axis of rotation, an embossing location being defined intermediate of the punch and die sides;

(b) a framework supporting the wheel;

(c) axially aligned associated punch blocks and die blocks located about the periphery of the punch side and die side of the embossing wheel, respectively, individual pairs of the punch blocks and die blocks being alignable with the embossing location by rotation of the wheel about the axis of rotation;

(d) hammer means located on each side of the embossing wheel for urging the punch block and die block aligned with the embossing location toward the embossing location;

(e) solenoid means including a solenoid shaft and mounted on a framework at either side of the embossing wheel for driving the hammer means;

(f) card guide means located intermediate of the punch and die sides of the embossing wheel for positioning a character embossing location on a card proximate the embossing location intermediate of the punch and die sides of the wheel and for supporting the sides and bottom of the card during embossing of the card, the card guide means including a notch proximate the character emboss location;

(g) stopping means for stopping the motion of the solenoid shaft at a repeatable embossing position so that character embossing height on the card is consistent;

(h) character return plate means being resiliently biased for returning the punch blocks and die blocks to a home position axially removed from the embossing position;

(i) card transport means for holding the card and moving the card through the embossing wheel intermediate of the punch and die sides; and (j) the solenoid shafts including pushers engaging the character return plate means so that the character return plate means does not engage the punch blocks or die blocks during embossing.

12. An apparatus according to claim 11, wherein the card guide means is positioned so that as the card bows during embossing, the card engages the card guide means and bowing is minimized.

13. An apparatus according to claim 11, wherein the hammer means are adjustable relative to the card guide means for minimizing card bowing.

14. A card embossing apparatus comprising:

(a) a framework;

(b) card transport means for transporting a card horizontally and vertically relative to the framework;

(c) an embossing wheel including associated punch and die sides having a multiplicity of axially aligned corresponding punch and die character blocks spaced around the periphery of the wheel, the embossing wheel being rotatable about an axis of rotation;

(d) card support means located between the punch side and the die side of the embossing wheel for supporting the card during the embossing process and for reducing actual deflection of the card, the card support means including a card bow control guide plate on the punch side of the card, the card bow control guide plate positioned so that card bowing during embossing is minimized;

(e) wheel drive means for aligning selected pairs of the punch and die character blocks on the embossing wheel with an emboss location;

(f) character block drive means for striking the selected punch and die blocks aligned with the emboss location so as to emboss a character onto the card, the card bow control guide plate engaging the card on either side and below the embossed location; and (g) stopping means having a repeatable stop location for maintaining consistent character embossing height on the card.

15. An apparatus according to claim 14, wherein the character block drive means is adjustable relative to the card bow control guide plate for minimizing card bow.

16. A method for embossing cards comprising the steps of:

(a) transporting a card to a card embossing mechanism having an embossing wheel including a punch side and a die side which have associated aligned character blocks spaced about the periphery of the wheel, the embossing mechanism further having a card bow control guide plate on the punch side of the card, the card bow control guide plate positioned so that card bowing during mechanism is minimized;

(b) rotating the embossing wheel so that a selected pair of associated character blocks is aligned with a character embossing location on the card, the card bow control guide plate engaging the card on either side and below the character embossing location;

(c) actuating opposing drive solenoids so that the solenoid shafts drive hammers against the associated character blocks, forming a raised letter on the card;

(d) moving the card to the next character embossing location and repeating the wheel rotating and solenoid actuating steps for the desired character and repeating the steps until the embossing is completed; and (e) transporting the card to the next card processing station.

17. An embossing apparatus comprising:

(a) a framework;

(b) card transport means for transporting a card horizontally and vertically relative to the framework;

(c) an embossing wheel including associated punch and die sides having a multiplicity of axially aligned corresponding punch and die character blocks spaced around the periphery of the wheel, the embossing wheel being rotatable about an axis of rotation;

(d) card support means located between the punch side and the die side of the embossing wheel for supporting the card during the embossing process and for reducing actual deflection of the card, the card support means including a card bow control guide plate on the punch side of the card, the card bow control guide plate positioned so that the card bowing during embossing is minimized;

(e) wheel drive means for aligning selected pairs of the punch and die character blocks on the embossing wheel with an emboss location, the card bow control guide plate engaging the card on either side and below the embossed location; and (f) character block drive means for striking the selected punch and die blocks aligned with the emboss location so as to emboss a character onto the card.

* * * * *